United States Patent [19]

Ricketts et al.

[11] 4,440,447

[45] Apr. 3, 1984

[54] METHOD FOR FORMING AN IN SITU OIL SHALE RETORT WITH EXPLOSIVE EXPANSION TOWARDS A HORIZONTAL FREE FACE

[75] Inventors: Thomas E. Ricketts; John E. Shaler, both of Grand Junction, Colo.

[73] Assignee: Occidental Oil Shale, Inc., Grand Junction, Colo.

[21] Appl. No.: 357,687

[22] Filed: Mar. 12, 1982

Related U.S. Application Data

[63] Continuation of Ser. No. 183,081, Sep. 2, 1980, abandoned.

[51] Int. Cl.[3] ..... E21B 43/247; E21C 41/10

[52] U.S. Cl. ..... 299/2; 102/312; 166/259; 299/13

[58] Field of Search ..... 166/259, 299; 102/311, 102/312; 299/2, 13

[56] References Cited

U.S. PATENT DOCUMENTS

| | | | |
|---|---|---|---|
| 410,165 | 9/1889 | Jacobs | 299/13 |
| 3,466,094 | 9/1969 | Haworth et al. | 299/13 |
| 3,611,933 | 10/1971 | Lanning | 166/299 X |
| 4,118,070 | 10/1978 | French et al. | 299/2 |
| 4,146,272 | 3/1979 | French | 299/2 |
| 4,238,136 | 12/1980 | Ricketts | 299/2 |

*Primary Examiner*—George A. Suchfield

*Attorney, Agent, or Firm*—Christie, Parker & Hale

[57] ABSTRACT

A fragmented permeable mass of formation particles containing oil shale and having a substantially uniformly distributed void fraction is formed in an in situ oil shale retort in a subterranean formation containing oil shale. The fragmented mass is formed by explosive expansion towards a horizontal free face. At least one generally horizontally extending void is formed in the subterranean formation and zones of unfragmented formation are left above and below such a void. An array of horizontally spaced apart substantially vertical columnar explosive charges is formed in at least one of the zones of unfragmented formation. The array of explosive charges includes a plurality of central explosive charges which are spaced apart from side boundaries of the retort and a plurality of outer explosive charges surrounding the central charges. Explosive in each outer explosive charge extends nearer the free face toward which unfragmented formation is to be explosively expanded than any portion of the explosive in a central explosive charge. Additionally, each outer explosive charge has a scaled depth of burial which is no greater than the scaled depth of burial of each central explosive charge. The explosive charges are thereafter detonated for explosively expanding the zone of unfragmented formation toward the void, forming the fragmented permeable mass of formation particles in the in situ oil shale retort.

49 Claims, 5 Drawing Figures

METHOD FOR FORMING AN IN SITU OIL SHALE RETORT WITH EXPLOSIVE EXPANSION TOWARDS A HORIZONTAL FREE FACE

CROSS REFERENCE TO RELATED APPLICATIONS

This is a continuation of application Ser. No. 183,081, filed Sept. 2, 1980, now abandoned.

FIELD OF THE INVENTION

This invention relates to the formation of an in situ oil shale retort containing a fragmented permeable mass of formation particles in a retort site within a subterranean formation. More particularly, this invention relates to expanding unfragmented formation toward a void for forming a fragmented permeable mass of formation particles in an in situ oil shale retort having a reasonably uniformly distributed void fraction.

BACKGROUND OF THE INVENTION

The presence of large deposits of oil shale in the high plateau, semi-arid region of the western United States has given rise to extensive efforts to develop methods for recovering shale oil from kerogen in the oil shale deposits. It should be noted that the term "oil shale" as used in the industry is, in fact, a misnomer; it is neither shale nor does it contain oil. It is a sedimentary formation comprising marlstone deposit with layers containing an organic polymer called "kerogen" which, upon heating, decomposes to produce liquid and gaseous products. It is the formation containing kerogen that is called "oil shale" herein and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents such as U.S. Pat. Nos. 3,661,423; 4,043,597; 4,043,598; and 4,192,554; and in U.S. Patent application Ser. No. 070,319 filed Aug. 27, 1979, now abandoned by Chang Yul Cha, entitled TWO-LEVEL, HORIZONTAL FREE FACE MINING SYSTEM FOR IN SITU OIL SHALE RETORTS. Each of these applications and patents is assigned to Occidental Oil Shale, Inc., assignee of this application, and each is incorporated herein by this reference.

These patents and applications describe in situ recovery of liquid and gaseous hydrocarbon materials from a subterranean formation containing oil shale, wherein such formation is explosively expanded to form a stationary fragmented permeable mass of formation particles containing oil shale within the formation, referred to herein as an in situ oil shale retort, or merely as a retort. Retorting gases are passed through the fragmented mass to convert kerogen contained in the oil shale to liquid and gaseous products, thereby producing retorted oil shale. One method of supplying hot retorting gases used for converting kerogen contained in the oil shale as described in U.S. Pat. No. 3,661,423, includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbons, and a residual carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process.

U.S. Pat. Nos. 4,043,597; 4,043,598; and 4,192,554 disclose methods for explosively expanding formation containing oil shale toward horizontal free faces to form a fragmented mass in an in situ oil shale retort. According to such a method, a plurality of vertically spaced apart voids of similar horizontal cross-section are initially excavated one above another within the retort site. A plurality of vertically spaced apart zones of unfragmented formation are temporarily left between the voids. An array of vertical columnar explosive charges is placed in each of the unfragmented zones and detonated to explosively expand each unfragmented zone upwardly and/or downwardly towards the void or voids above and/or below it to form a fragmented mass having an average void volume about equal to the void volume of the initial voids. Retorting of the fragmented mass is then carried out to recover shale oil from the oil shale.

U.S. Patent application Ser. No. 070,319 discloses a method for explosively expanding formation containing oil shale towards a horizontal free face to form a fragmented mass in an in situ oil shale retort. According to such a method, a void having a horizontal cross-section similar to the horizontal cross-section of the retort being formed is initially excavated. A plurality of vertically spaced apart zones of unfragmented formation are left above the void. Explosive is placed in each of the unfragmented zones and detonated for explosively expanding such zones towards the void to form a fragmented mass in the retort having an average void volume about equal to the void volume of the initial void. The overlying zones can be expanded towards the void in a single round or a plurality of rounds. Retorting of the fragmented mass is then carried out to recover shale oil from the oil shale.

It is desirable to have a generally uniformly distributed void fraction in the fragmented mass so that there is generally uniform permeability. Thus, oxygen-supplying gas and combustion gas can flow reasonably uniformly through the fragmented mass during retorting operations. A fragmented mass having generally uniform permeability avoids bypassing portions of the fragmented mass by retorting gas as can occur if there is gas channeling through the mass due to non-uniform permeability.

When using vertical columnar explosive charges for explosively expanding formation, some of the charges can be located close to the vertical walls of a void towards which expansion is directed. These charges are not free to crater upward, but are confined on one side by the wall. Formation expanded by these charges is directed inwardly away from the walls and not vertically, as desired. This can cause the fragmented mass of formation particles formed to have a higher void fraction along the walls of the retort and a lower void fraction near the center. Having a fragmented permeable mass with a higher void fraction along the walls and a lower void fraction in about the center can result in gas channeling along the walls and consequent reduction in the efficiency of the retorting process.

It is, therefore, desirable to provide a method which results in formation of a fragmented mass having a reasonable uniformity of particle size and, additionally, a void fraction distribution which is uniform for eliminating the problem of gas channeling along the edges of the retort.

DRAWINGS

These and other features, aspects, and advantages of the present invention will be more fully understood when considered with respect to the following detailed description, appended claims, and accompanying drawings, wherein:

Figure 1:
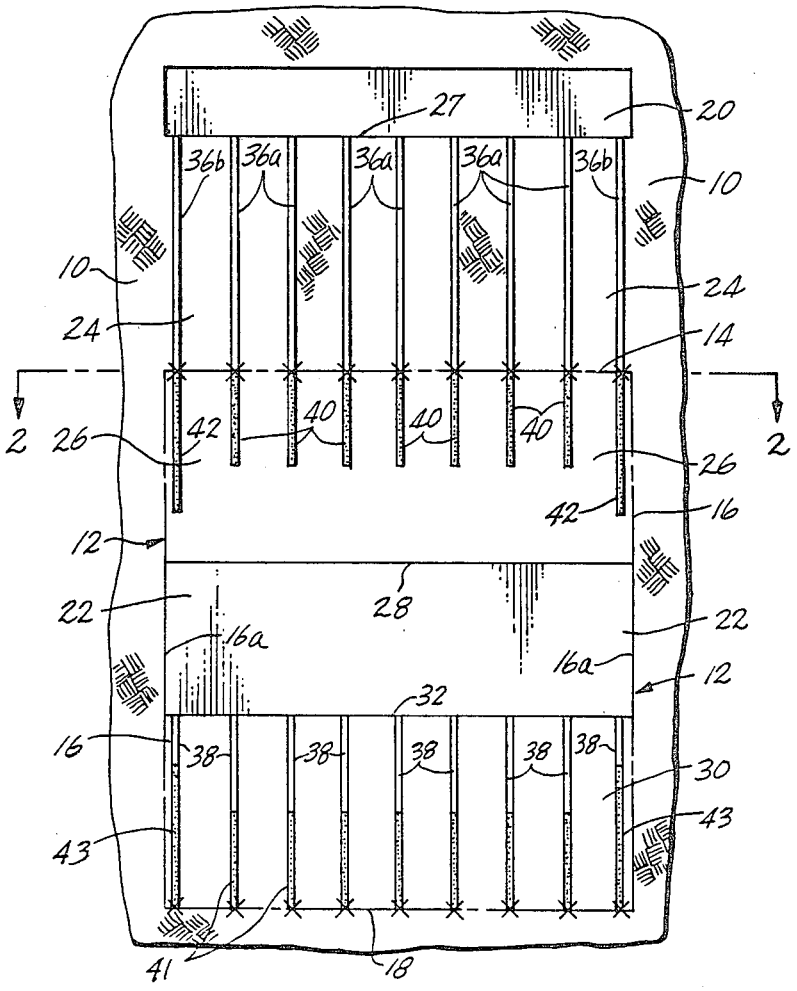
FIG. 1 is a fragmentary, semi-schematic vertical cross-sectional view showing a portion of a subterranean formation containing oil shale at one stage during preparation for explosive expansion for forming an in situ oil shale retort.
Figure 4:
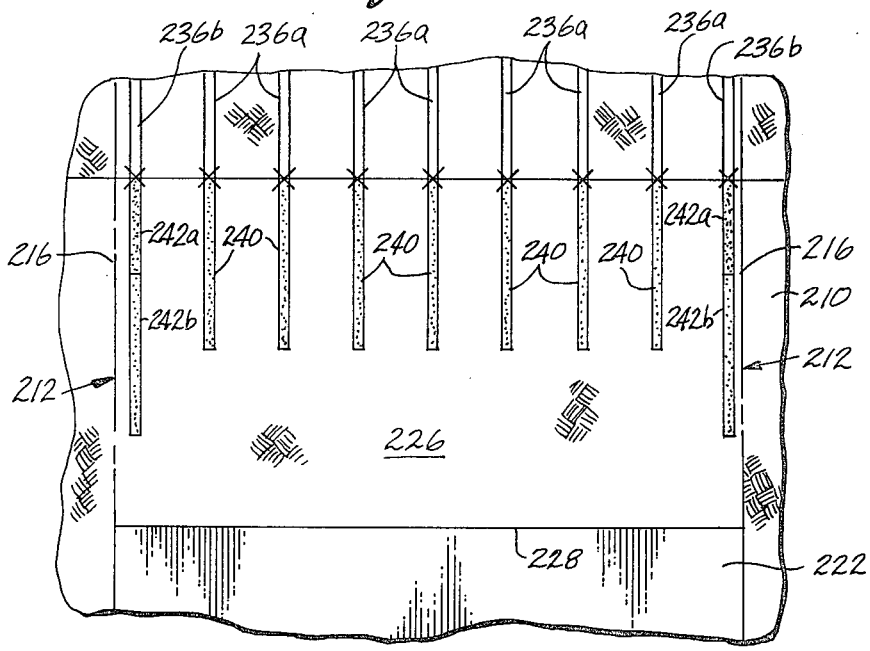
Figure 5:
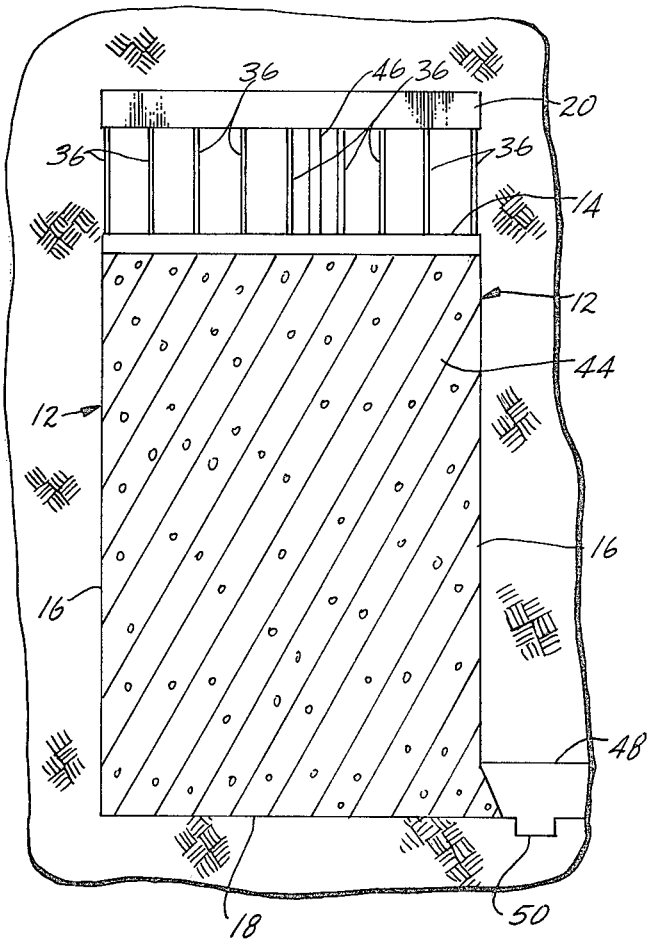

FIG. 4 is a fragmentary semi-schematic vertical cross-sectional view showing a portion of a subterranean formation similar to the subterranean formation of FIG. 1 prepared for explosive expansion using explosive charges having another exemplary configuration; and FIG. 5 is a fragmentary semi-schematic vertical cross-sectional view of an in situ oil shale retort formed in accordance with this invention.

SUMMARY OF THE INVENTION

This invention relates to a method for forming a fragmented permeable mass of formation particles in an in situ oil shale retort having top, bottom, and side boundaries of unfragmented formation in a subterranean formation containing oil shale. At least one generally horizontally extending void is formed in the subterranean formation. The void is bounded by generally vertical side walls and zones of unfragmented formation above and below the void. An array of spaced apart explosive charges is formed in at least one of the zones of unfragmented formation. The array of explosive charges comprises at least one central explosive charge spaced apart from the side boundaries and at least one outer explosive charge spaced apart from and around the central charges. The actual depth of burial of each such outer explosive charge is less than that of the actual depth of burial of each such central explosive charge and the scaled depth of burial of each such outer explosive charge is not more than the scaled depth of burial of each such central explosive charge. The explosive charges are detonated for explosively expanding such a zone of unfragmented formation toward the void for forming a fragmented permeable mass of formation particles in the in situ oil shale retort.

DETAILED DESCRIPTION

Figure 2:
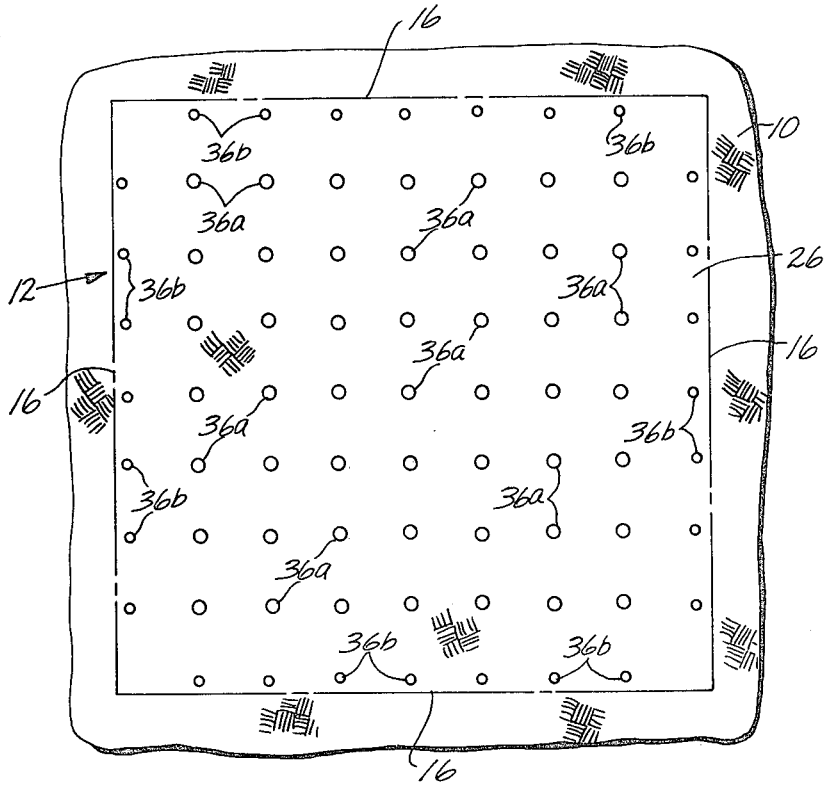
FIG. 2 is a semi-schematic horizontal cross-sectional view taken on line 2—2 of FIG. 1 showing an array of blastholes.

Referring to FIGS. 1 and 2, there are shown semi-schematic vertical and horizontal cross-sectional views of a portion of a subterranean formation 10 containing oil shale. The subterranean formation is at one stage of preparation for explosive expansion for forming an in situ oil shale retort 12. The in situ retort is rectangular in horizontal cross-section, having a top boundary 14, four vertically extending side boundaries 16, and a bottom boundary 18 of unfragmented formation. If desired, retorts having other cross-sections or other shapes can also be formed by practice of principles of this invention.

When explosively expanding formation using a horizontal free face system of an exemplary embodiment, an open base of operation 20 can be excavated in the formation for providing effective access across substantially the entire horizontal cross-section of the retort being formed. The base of operation can be used during formation of the retort and additionally can facilitate ignition of a fragmented permeable mass of formation particles formed in the retort. The base of operation can also provide a location for control of introduction of oxygen-supplying gas into the retort and for evaluating performance of the retort during its operation. If desired, when no open base of operation is used, blastholes can be drilled from a series of drifts in the subterranean formation extending above or on the side of the retort.

Alternatively, if desired, blastholes can be drilled and loaded from the ground surface and oxygen-supplying gas can be introduced from above ground, rather than excavating a subterranean base of operation.

A generally horizontally extending void 22 bounded by generally vertical side walls **16*a*** is excavated at a level spaced vertically below the base of operation. It is preferable that the void comprise at least about 15% of the total volume of the retort being formed.

A layer of unfragmented formation is left which extends vertically between the base of operation 20 and the void 22. The layer of unfragmented formation above the void 22 can comprise a sill pillar 24 of unfragmented formation extending from about the floor 27 of the base of operation to the top boundary 14 of the retort being formed. The sill pillar acts as a barrier between the in situ oil shale retort and the base of operation during retorting operations, thereby protecting the base of operation from heat and from gases evolved during such retorting operations. In an alternative embodiment, the unfragmented formation above the top boundary extends all the way to the ground surface.

The layer of unfragmented formation can also be comprised of an upper zone 26 of unfragmented formation. The upper zone of unfragmented formation extends horizontally across the retort site between the top boundary 14 of the retort being formed and a substantially horizontal free face 28 above the void 22. A lower zone 30 of unfragmented formation is left in the subterranean formation below the void 22, wherein the lower zone extends horizontally across the retort site between the bottom boundary 18 of the retort being formed and a substantially horizontal free face 32 at the floor of the void.

For clarity of illustration, in the exemplary embodiment, unfragmented formation is expanded toward only one void, i.e., the void 22. If desired, however, in practice of principles of this invention, more than one void can be excavated in the subterranean formation and formation can be expanded toward the excavated voids.

In other embodiments of practice of this invention, formation can be expanded only upwardly toward a void above the formation or alternatively only downwardly toward a void below the formation. Alternatively and/or additionally, formation from one zone of unfragmented formation can be expanded both upwardly toward a void above and downwardly toward a void below. Also, plural layers of formation can be expanded upwardly or downwardly toward a single underlying or overlying void.

Additional details of expanding formation toward several voids is described in U.S. Pat. No. 4,192,554, incorporated hereinabove by reference.

In the exemplary embodiment, a plurality of substantially vertical horizontally spaced apart blastholes 36 are drilled through the sill pillar 24 and into the upper zone 26 of unfragmented formation from the base of operation 20, forming an array of spaced apart blastholes. In other embodiments, where no base of operation is provided, the blastholes can be drilled from a drift adjacent the retort or from the ground surface or upwardly from a void below the formation to be expanded.

Additionally, a plurality of substantially vertical horizontally spaced apart blastholes 38 are drilled into the lower zone 30 of unfragmented formation from the void 22, forming another array of spaced apart blastholes.

The blastholes are shown out of proportion in the figures for clarity of illustration, i.e., the blastholes are actually much smaller in diameter relative to the formation than shown.

The blastholes can be formed in a rectangular array including a square array or can be formed in other configurations if desired. The blastholes of the exemplary embodiment are generally perpendicular to the free faces of the upper and lower zones of unfragmented formation and are formed as a square array of blastholes, i.e., the spacing distance between blastholes is equal in orthogonal directions. When the retort being formed is not square in horizontal cross-section, but has sides of unequal length, it may be desirable to form a rectangular array of spaced apart blastholes which is not square.

An understanding of the configuration of the array of blastholes can be obtained by referring to FIG. 2 which shows the array of blastholes 36 formed in the upper zone 26 of unfragmented formation. The outline of the horizontal free face 28 is indicated by the side boundaries 16 of the retort which surround the array of blastholes 36.

Central blastholes designated **36*a* are remote from the side boundaries 16 and outer blastholes designated 36*b*** are spaced apart from and around, preferably in a band surrounding the central blastholes. Although not shown, if desired, blastholes can also be formed at the corners of the array.

In an exemplary embodiment, it is preferable that the outer blastholes **36*b* are spaced apart from the walls of the base of operation or void 22, i.e., the walls of the retort, only that amount required due to the design of the drilling equipment used for drilling the blastholes. Additionally, it is preferable that the blastholes 36*b* are longer and have a smaller diameter than do the blastholes 36*a*** for purposes which are described below.

Each of the central blastholes **36*a* is loaded with explosive for forming substantially vertical columnar central explosive charges 40. Similarly, each of the outer blastholes 36*b* is loaded with explosive for forming substantially vertical columnar outer explosive charges 42**. The portion of each blasthole above the explosive charge may be stemmed with inert material.

The outer explosive charges 42 are preferably located close to the side boundaries 16 of the retort as described above. This enhances explosive expansion of formation adjacent the side boundaries, i.e., adjacent the walls of the retort. However, when the outer charges 42 are close to the side boundaries of the retort, they are located near the vertical walls **16*a* of the void 22 towards which explosive expansion of the upper zone 26 of unfragmented formation is to be directed. Because of the proximity of the outer charges to the wall 16*a*, they are not completely free to crater toward the free face 28**, but are confined to some extent by the void walls.

To overcome the tendency of outer charges to expand the outer portion of the formation inwardly, the configuration of outer charges provided in practice of principles of this invention is different from the configuration of the central charges.

It is desired in practice of this invention that a portion of the explosive in such an outer explosive charge 42 be nearer the free face, i.e., nearer the void, than any portion of the explosive in the center charges 40.

In an exemplary embodiment, a first portion of such an outer explosive charge 42, i.e., the end remote from the void 22, is about the same distance from the void as the first portion, i.e., the end remote from the void 22 of such a central explosive charge 40. Each of the central charges 40 extends from the upper boundary 14 of the retort being formed about half the distance to the free face 28. The central explosive charge, therefore, extends into the upper zone 26 of unfragmented formation a distance equal to about one-half the thickness of the upper zone. Each of the outer explosive charges 42 extends from the upper boundary 14 from about $\frac{2}{3}$ to $\frac{3}{4}$ the distance to the free face 28. The outer explosive charges, therefore, extend into the upper zone of unfragmented formation a distance equal to about $\frac{2}{3}$ to $\frac{3}{4}$ the thickness of the upper zone. A portion of the explosive in the outer charges 42 is, therefore, nearer the free face 28 than any of the explosive in the center charges 40. If desired, outer charges can be provided which are longer or shorter than the outer charges 42 of the exemplary embodiment.

Detonators designated by an "x" are placed into each blasthole for detonation of the charges and then the blastholes are stemmed with inert material such as sand or gravel or the like. The detonators in the outer charges may, however, be placed at a location in the blastholes that is closest to the free face to promote better vertical movement of formation into the void. In other words, the point of initiation of detonation of explosive comprising an outer charge can be relatively nearer the void while the point of initiation of detonation of explosive comprising a central charge can be relatively more remote from the void.

By providing explosive nearer the free face in the outer explosive charges 42, upon detonation of such charges, vertical movement of unfragmented formation from near the side boundaries 16 of the retort is enhanced. This results in a more evenly distributed void fraction across the horizontal extent of the retort, enhancing uniform gas flow through the retort. The lower zone of unfragmented formation is prepared for explosive expansion upwardly toward the void 22 by forming explosive charges 41 and 43 in the blastholes 38. The charges formed in the blastholes 38 are similar to the explosive charges formed in the blastholes 36. That is, the outer explosive charges 43 have a portion nearer the free face 32 below the void than any portion of the central explosive charges 41. For simplicity, therefore, the description of explosive charges is limited to the explosive charges formed in the upper zone of unfragmented formation.

In one embodiment, the outer blastholes **36*b* shown in FIG. 2 have a spacing distance equal to the spacing distance of the central blastholes 36*a*. Additionally, the distance between an outer blasthole 36*b* and an adjacent central blasthole 36*a*** is about equal to the spacing distance between adjacent central blastholes. "Spacing distance" as used herein refers to the distance between adjacent blastholes or explosive charges in an array.

In an embodiment where the spacing distance between outer explosive charges 42 is the same as the spacing distance between center charges 40, it is desired that the blasthole diameter, i.e., the explosive charge diameter of the outer charges, be less than the diameter of the center charges. The charges 42 can, therefore, be made longer than the charges 40 for providing explosive nearer the free face 28 while maintaining the same amount of explosive in each outer blasthole as is contained in each center blasthole. The charge length of the outer explosive charges can be modified as desired using this technique, while maintaining a selected powder factor for the entire array.

"Powder factor" as used herein is that amount or energy of explosive used to explosively expand a given volume of unfragmented formation.

In the exemplary embodiment, the actual depth of burial of each outer explosive charge 42 is less than the actual depth of burial of each center explosive charge 40. The "actual depth of burial (DOB)" as used herein is the distance from the free face towards which the unfragmented formation is being expanded to the center of the mass of the columnar explosive charge in such a zone of unfragmented formation.

When the amount of explosive in each outer charge 42 is the same as the amount of explosive in each central explosive charge 40 and the actual depth of burial for each outer charge is less than the actual depth of burial for each center charge, the scaled depth of burial of such an outer charge is less or "shallower" than the scaled depth of burial of such a center charge. It is preferred that the scaled depth of burial of an outer charge is not more than the scaled depth of burial of a center charge to enhance fragmentation of formation by the outer charges.

The scaled depth of burial as it applies to cratering is described by B. B. Redpath in an article entitled "Application of Cratering Characteristics to Conventional Blast Design", *Monograph 1 on Rock Mechanics Applications in Mining,* Soc. Min. Eng. and Am. Inst. Min. Met. and Pet. Eng. (New York, 1977). A copy of the article accompanies this application and is incorporated herein by this reference. The scaled depth of burial (SDOB) of an explosive charge can be expressed in units of distance over weight to the $\frac{1}{3}$ power or preferably distance over energy of explosive to the $\frac{1}{3}$ power. For example, $SDOB = L/W^{1/3}$ with units of millimeters per calorie to the $\frac{1}{3}$ power. The distance, L, referred to as burden distance in the equation for scaled depth of burial, is the actual depth of burial as described hereinabove. The weight or energy, W, of the explosive is the total weight or energy of the column of explosive. The scaled depth of burial can be altered by changing the actual depth of burial of an explosive charge or by changing the amount of explosive in the blasthole, such as by changing the diameter of the blasthole and/or by using more or less energetic explosive in such a blasthole.

In the exemplary embodiment, the powder factor of such an outer explosive charge 42 is higher than the powder factor of such a center charge 40. This is because, although each outer charge 42 contains the same amount of explosive as does each center charge, such an outer charge is not free to expand formation in all directions, but is inhibited by the vertical walls of the void as described above. Each central explosive charge expands about twice the amount of formation as is expanded by each outer explosive charge. Therefore, the powder factor of each outer explosive charge is up to about twice the powder factor of each central explosive charge.

Having a higher powder factor in such an outer charge, in addition to having explosive in the outer charge nearer the free face towards which the unfragmented formation is expanded than does such a central charge, can enhance the expansion of formation from near the side walls of the retort.

In another exemplary embodiment, the spacing distance between outer explosive charges can be made less than the spacing distance between center charges. When spacing distance between the outer charges is made less than the spacing distance between the center charges, the diameter of the blastholes, i.e., the diameter of the charges, can be calculated so that the total amount of explosive in all of the outer charges provided with less spacing is about equal to the total amount of explosive originally in the outer charges when the spacing was equal to the spacing of the center charges. By using this technique, the powder factor of the entire array can be maintained at a desired value when the spacing between outer charges is changed.

After the explosive charges are formed in both the upper and lower zones of unfragmented formation, they are detonated for explosively expanding the zones of unfragmented formation toward the void 22, forming a fragmented permeable mass of formation particles in the in situ oil shale retort. If desired, the charges can be detonated simultaneously or can be detonated in a single round with time delays between detonation of the charges.

Detonation in a single round as used herein means detonation of a number of explosive charges either simultaneously or with only a short time delay between separate detonations. The time delay between explosions in a sequence is short when formation explosively expanded by detonation of one explosive charge has not yet moved or is still in motion at the time of detonation of a subsequent explosive charge.

Figure 3:
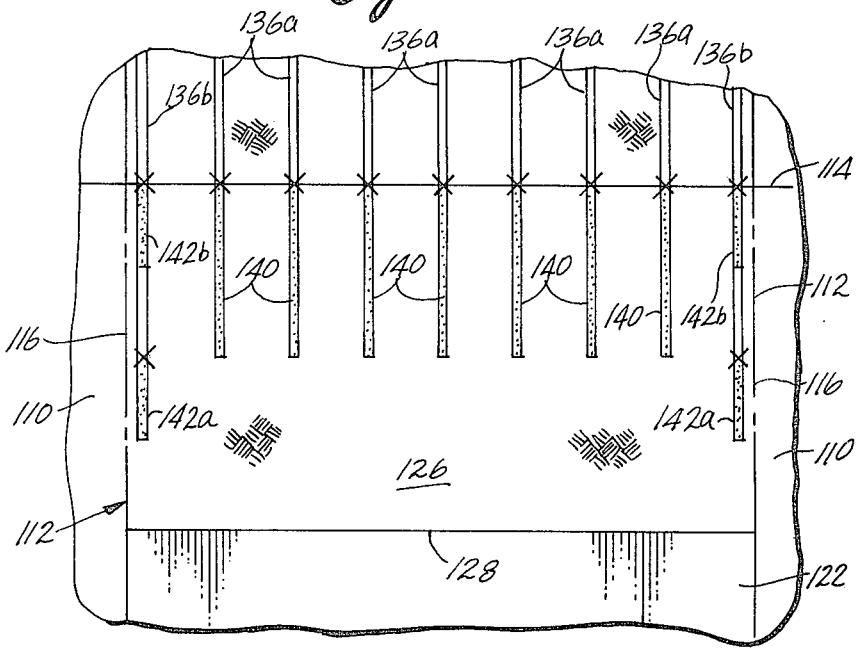
FIG. 3 is a fragmentary semi-schematic vertical cross-sectional view showing a portion of a subterranean formation similar to the subterranean formation of FIG. 1 prepared for explosive expansion using explosive charges having an exemplary configuration.

Another exemplary embodiment of this invention can be understood by referring to FIG. 3 which is a fragmentary semi-schematic cross-sectional view of a subterranean formation 110 at one stage in preparation for explosive expansion for forming an in situ oil shale retort 112. The subterranean formation 110 and the in situ oil shale retort 112 being formed are similar to the in situ oil shale retort 12 being formed in the subterranean formation 10 as illustrated in FIG. 1. Once again, only the explosive charges formed in an upper zone 126 of unfragmented formation for expanding the formation toward a single void 122 will be described for simplicity.

An array of horizontally spaced apart vertical blastholes 136 is drilled downwardly into an upper zone of unfragmented formation 126. The array of blastholes comprises a plurality of central blastholes **136*a* spaced apart from the side boundaries 116 and a plurality of outer blastholes 136*b*** adjacent the side boundaries surrounding the center blastholes. The outer blastholes are longer than the central blastholes.

Each central blasthole **136*a* is loaded with explosive, forming an array of vertical columnar center or central explosive charges 140. Each outer blasthole 136*b* is loaded with explosive for forming a plurality of vertical columnar outer explosive charges 142 in each such outer blasthole. The outer charges 142 are in a band surrounding the center charges. Corner holes can be provided, if desired, as was discussed for the embodiment shown in FIG. 2**.

It is preferred that the outer explosive charges 142 are formed so that at least a portion of the explosive used for forming the outer explosive charges is nearer the free face 128 than any portion of the explosive comprising the central charges 140. This enhances vertical expansion of the formation from detonation of the outer charges.

In an exemplary embodiment, two outer explosive charges are formed in each outer blasthole **136*b*. A first outer explosive charge 142*a* is formed in a portion of the outer blasthole relatively nearer the void 122 and a second outer explosive charge 142*b*** is formed in a portion of the outer blasthole relatively more remote from the void.

Detonators designated by an "x" are placed into each of the outer and central charges. Detonators in all or some of the outer charges may be placed at locations closest to the free face 128. The outer blastholes **136*b* are stemmed with an inert material between the charges 142*a* and 142*b*** and all of the blastholes are stemmed above the respective explosive charges.

The far end, i.e., the end of such a second outer explosive charge, which is remote from the void, is about the same distance from the void as the far end of such a central explosive charge 140.

In the exemplary embodiment, the outer explosive charges **142*a* and 142*b* have about the same diameter as the charges 140. The charges 140 extend from the upper boundary 114 of the retort being formed about one-half the distance to the free face 128 towards which the zone of unfragmented formation 126 is to be expanded. The explosive charges 142*b* extend from about the upper boundary 114 about one-fourth the distance to the free face 128. The outer explosive charges 142*a* extend from about the center of the height of the zone of unfragmented formation 126 about half the distance to the free face 128**.

Explosive in the first outer explosive charges **142*a* is nearer the free face 128 than any portion of the explosive in the central explosive charges 140**.

It is preferred that the scaled depth of burial of each first outer explosive charge **142*a* is about equal to the scaled depth of burial of each second outer explosive charge 142*b***. This can provide for about equal movement and fragmentation of unfragmented formation explosively expanded by each of the outer explosive charges.

Additionally, it is desirable that the scaled depth of burial of each first and second outer explosive charge be made equal to or less than, i.e., no greater than, the scaled depth of burial of each central explosive charge. Having the scaled depth of burial equal to or less than the scaled depth of burial of each central charge enhances fragmentation of formation adjacent the boundaries of the retort site which, as described above, is inhibited vertically by the vertical walls of the void.

If desired, the scaled depth of burial of the outer explosive charges can be made less than the scaled depth of burial of the central explosive charges by increasing the blasthole diameter of the outer blastholes, by using a more energetic explosive for the outer charges or by increasing the column length of the outer charges.

Although the lower zone of unfragmented formation is not shown, it is prepared for explosive expansion by forming explosive charges in such a lower zone which are similar to the outer and central charges formed in the upper zone.

After the explosive charges are formed, the charges are detonated for explosively expanding the zones of unfragmented formation toward the void for forming a fragmented permeable mass of formation particles in the in situ oil shale retort.

In an exemplary embodiment, the explosive charges are detonated in a time delay sequence in a single round. The central explosive charges are detonated first and then the first outer explosive charges **142*a* are detonated for expanding portions of the zone of unfragmented formation 126 toward the free face 128. Detonation of the center and first outer explosive charges creates a new free face towards which unfragmented formation from detonation of the second outer explosive charges 142*b* is expanded. After the first outer explosive charges and center charges are detonated, the second outer explosive charges 142*b* are detonated. In another exemplary embodiment, the second outer explosive charges 142*b* are detonated at the save time as the central explosive charges 140** with the first outer charges initiated previously.

A similar time delay sequence is used for expanding the lower zone of unfragmented formation toward the void at about the same time as the upper zone is expanded.

Having explosive comprising such a first outer explosive charge **142*a* closer to the free face 128 than explosive comprising such a center charge 140** can enhance vertical expansion of formation by the first outer charges, thereby enhancing uniform distribution of void fraction throughout the cross-section of the retort being formed.

FIG. 4 is a fragmentary semi-schematic cross-sectional view of a subterranean formation 210 at one stage in preparation for explosive expansion for forming an in situ oil shale retort 212 according to an additional exemplary embodiment of practice of principles of this invention. The subterranean formation 210 and the retort 212 being formed therein are similar to the subterranean formation 10 and retort 12 being formed as illustrated in FIG. 1. Again, only the explosive charges in an upper zone of unfragmented formation for expanding the formation toward a single void will be described for simplicity.

An array of horizontally spaced apart vertical blastholes 236 is drilled downwardly or upwardly into an upper zone of unfragmented formation 226. The array of blastholes comprises a plurality of center blastholes 236*a* spaced apart from the side boundaries 216 of the retort and a plurality of outer blastholes 236*b* surrounding the center blastholes. The blastholes 236*b* are longer than the blastholes 236*a*.

Each central blasthole 236*a* is loaded with explosive, forming an array of vertical columnar center explosive charges 240. Each of the outer blastholes is loaded with explosive, forming an array of vertical columnar outer explosive charges 242.

A portion of the explosive in such an outer charge is nearer the free face 228 than any of the explosive in such a center charge. Each of the outer explosive charges 242 has a different energy per unit volume of charge in a first portion of the length of the charge than the energy per unit volume of charge in a second portion of the length of the charge. For example, such an outer explosive charge 242 can have a higher energy per unit volume of charge in a portion of the charge 242*a* more remote from the void 222 and a lower energy per unit volume in a portion of the charge 242*b* nearer the void. Varying the energy of the explosive along the length of the columnar explosive charge can be accomplished by loading the portion of such an outer blasthole more remote from the free face with a more energetic explosive and a portion of the blasthole nearer the void, i.e., nearer the free face, with a less energetic explosive.

This can be accomplished, for example, using a pumpable explosive, such as a slurry explosive, because the explosive formulation of such a slurry can be varied as the slurry is pumped into such a blasthole.

It is desired that the total energy of explosive in each such outer blasthole is about the same as the energy of explosive in such a center blasthole to maintain a desired powder factor for the entire array.

In this embodiment, at least a portion of the explosive in each outer charge can be nearer the free face 228 than any of the explosive in a center charge, while the relationship of the actual depth of burial and scaled depth of burial of the outer charges to the central charges can vary, depending on the density of explosive used in the charges.

Preferably, however, the actual depth of burial of an outer charge is not more than the actual depth of burial of a central charge. Additionally, it is preferred that the scaled depth of burial of an outer charge is not more than the scaled depth of burial of such a central charge.

By using these preferred relationships of actual and scaled depths of burial of outer charges to center charges, fragmentation of formation by the outer charges is enhanced.

Having explosive in the outer charges nearer the free face than explosive in the center charges enhances vertical movexent of formation explosively expanded from near the edges of the retort. Additionally, having the more energetic explosive in the portion of the outer charge more remote from the free face enhances fragmentation and movement of formation in the portion of the unfragmented formation more remote from the free face.

Although detonators designated by an "x" are shown in both the outer and central charges at a location remote from the free face 228, detonators can be placed in the outer charges at a location in the charge nearest the free face. Initiating detonation of explosive in such an outer charge at a location in the charges nearest the free face can further enhance vertical expansion of formation near the side boundaries of the retort.

The outer and central explosive charges are then detonated either simultaneously or in a single round of time delayed explosions for explosively expanding the zone of unfragmented formation 226 toward the void, forming a fragmented permeable mass of formation particles in the retort.

In the exemplary embodiments described above, the edge or outer explosive charges are formed as near the side boundaries of the retort being formed as drilling equipment design allows.

If desired, however, the outer explosive charges can be moved laterally from the side boundaries or wall of the void. Moving the outer explosive charges from the side boundaries reduces the inhibiting effect of the walls, enabling such outer charges to expand more formation. When edge or outer charges are spaced laterally from the walls of the void, it is desirable that the distance from the wall to such charges is not more than about ½ the spacing distance between explosive charges. If the charges are moved more than ½ the spacing distance from the void walls, then the side boundaries of the retort can be irregular after the charges are detonated. This can cause uneven gas flow through the retort.

As described above, if desired, the zone of unfragmented formation below a void can also be prepared for explosive expansion toward the void. The zone below the void, i.e., a lower zone, is prepared using principles described in any of the alternative embodiments for preparation of an upper zone. Similar arrangements can also be used in each of a plurality of zones explosively expanded downwardly towards an underlying void, either in a single round or in a plurality of rounds.

After a zone or zones of unfragmented formation are expanded, forming a fragmented permeable mass 44 of oil shale particles in an in situ oil shale retort 12, as illustrated in FIG. 5, the final preparation steps for producing liquid and gaseous products from the retort are carried out. These steps include drilling at least one gas feed inlet passage 46 downwardly to the top boundary 14 of unfragmented formation so that oxygen-supplying gas can be introduced into the fragmented mass during retorting operations. Alternatively, at least a portion of the blastholes 36 can be used for introduction of the oxygen-supplying gas. A substantially horizontal product withdrawal drift 48 extends away from the lower portion of the fragmented mass at a lower production level in the retort. The product withdrawal drift is used for removal of liquid and gaseous products of retorting.

If desired, liquid and gaseous products can be withdrawn through one or more raises which extend upwardly from a lateral drift under the retort into a bottom portion of the fragmented mass.

During retorting operations, a combustion zone is established in the fragmented mass of formation particles and the combustion zone is advanced downwardly through the fragmented mass by introduction of oxygen-supplying gas into the retort. Combustion gas produced in the combustion zone passes through the fragmented mass to establish a retorting zone on the advancing side of the combustion zone, wherein kerogen in the oil shale is retorted to produce liquid and gaseous products of retorting. The liquid products and an off gas containing gaseous products pass to the bottom of the fragmented mass and are withdrawn from the product withdrawal drift 48. A pump (not shown) is used to withdraw liquid products from a sump 50 to above ground. Off gas is withdrawn by a blower (not shown) and passed to above ground.

The above description of a method for recovering shale oil from a subterranean formation containing oil shale, including the description of preparing zones of unfragmented formation for explosive expansion, is for illustrative purposes. Because of variations which will be apparent to those skilled in the art, the present invention is not intended to be limited to the particular embodiments described above. The scope of the invention is defined in the following claims.

What is claimed is:

1. A method for forming a fragmented permeable mass of formation particles in an in situ oil shale retort having top, bottom, and side boundaries of unfragmented formation in a retort site in a subterranean formation containing oil shale, the method comprising the steps of:

forming at least one void within the retort site in the subterranean formation, the void bounded by generally vertical side walls and zones of unfragmented formation above and below, the surface adjacent the void of at least one of such zones of unfragmented formation forming a substantially horizontal free face towards which such a zone of unfragmented formation is to be expanded;

forming an array of spaced apart explosive charges in the zone of unfragmented formation, the array of explosive charges comprising at least one central explosive charge spaced apart from the side boundaries and at least one outer explosive charge closer to an adjacent side boundary than such a central explosive charge the actual depth of burial of each such outer explosive charge being less than the actual depth of burial of each such central explosive charge, and the scaled depth of burial of each such outer explosive charge being not more than the scaled depth of burial of each such central explosive charge; and detonating the array of explosive charges for explosively expanding the zone of unfragmented formation toward its substantially horizontal free face for forming a fragmented permeable mass of formation particles in the in situ oil shale retort.

2. The method according to claim 1 wherein each outer and central explosive charge has a first portion remote from said void wherein the first portion of each such outer charge is about the same distance from said void as the first portion of each such central charge.

3. The method according to claim 2 wherein each such central charge extends into the zone of unfragmented formation to be explosively expanded a distance equal to about one-half the thickness of such zone and each outer explosive charge extends into such zone to be explosively expanded a distance equal to about two-thirds to about three-fourths the thickness of such zone.

4. The method according to claim 1 wherein the distance between adjacent outer explosive charges is less than the distance between adjacent central explosive charges.

5. The method according to claim 1 wherein the distance between an outer explosive charge and an adjacent central explosive charge is about equal to the distance between the adjacent central explosive charges.

6. The method according to claim 1 wherein the distance between adjacent central explosive charges is about equal to the distance between adjacent outer explosive charges.

7. The method according to claim 6 comprising positioning outer explosive charges within such zone of unfragmented formation to be explosively expanded such that the distance from each outer explosive charge to the closest wall of the retort adjacent thereto is not more than about one-half the distance between adjacent outer explosive charges.

8. The method according to claim 1 wherein the outer explosive charges vary along their length in energy per unit volume of charge.

9. The method according to claim 8 wherein the energy per unit volume of charge of each such outer explosive charge is lower in a portion of the outer explosive charge nearer the void and is higher in a portion of the outer explosive charge more remote from the void.

10. A method for forming a fragmented permeable mass of formation particles in an in situ oil shale retort in a retort site in a subterranean formation containing oil shale, the in situ oil shale retort having top, bottom, and side boundaries of unfragmented formation, comprising the steps of:

forming at least one void within the retort site in the subterranean formation, the void bounded by generally vertical side walls of unfragmented formation and zones of unfragmented formation above and below, the surface adjacent the void of at least one of such zones of unfragmented formation forming a substantially horizontal free face towards which such a zone of unfragmented formation is to be expanded;

forming an array of spaced apart substantially vertical blastholes in the zone of unfragmented formation, the array of blastholes comprising central blastholes remote from the side boundaries and outer blastholes spaced apart from and about the central blastholes;

loading each of the central blastholes with explosive to thereby form a plurality of substantially vertica columnar central explosive charges;

loading each of the outer blastholes with explosvie to thereby form a plurality of substantially vertical columnar outer explosive charges, the scaled depth of burial of each such outer explosive charge being less than the scaled depth of burial of each such central explosive charge and the powder factor of each such outer explosive charge being greater than the powder factor of each such central explosive charge; and detonating the explosive charges for explosively expanding the zone of unfragmented formation toward its substantially horizontal free face for forming a fragmented permeable mass of formation particles in the in situ oil shale retort.

11. The method according to claim 10 wherein each such outer explosive charge has an actual depth of burial which is not more than the actual depth of burial of each such central explosive charge.

12. The method according to claim 11 wherein each outer explosive charge has a length which is greater than the length of each central explosive charge.

13. The method according to claim 12 wherein the length of each such central explosive charge is about one-half the thickness of the zone of unfragmented formation being explosively expanded.

14. The method according to claim 13 wherein the length of each such outer explosive charge is from about two-thirds to about three-fourths the thickness of the zone of unfragmented formation being explosively expanded.

15. The method according to claim 12 wherein each such outer explosive charge has a diameter less than the diameter of each such central explosive charge.

16. The method according to claim 10 wherein a portion of each such outer explosive charge is closer to the void than any portion of any such central explosive charge.

17. The method according to claim 10 wherein the powder factor of each such outer explosive charge is about twice the powder factor of each such central explosive charge.

18. The method according to claim 10 wherein the distance between adjacent central blastholes is about equal to the distance between adjacent outer blastholes.

19. The method according to claim 10 comprising forming outer blastholes at a location within the zone of unfragmented formation to be explosively expanded such that the distance from each outer blasthole to an adjacent side boundary of the retort is not more than about one-half the distance between adjacent central blastholes.

20. The method according to claim 10 comprising initiating detonation of the outer explosive charges at about a point in the charge relatively nearer the void than the point of initiation detonation of the central charges.

21. A method for forming a fragmented permeable mass of formation particles in an in situ oil shale retort having top, bottom, and side boundaries of unfragmented formation in a retort site in a subterranean formation containing oil shale, the method comprising the steps of:

(a) forming at least one void within the retort site in the subterranean formation, leaving zones of unfragmented formation above and below such a void, the surface adjacent the void of at least one of such zones of unfragmented formation forming a substantially horizontal free face towards which such a zone of unfragmented formation is to be expanded;

(b) forming an array of horizontally spaced apart substantially vertical blastholes in the zone of unfragmented formation, the array of blastholes comprising a plurality of central blastholes spaced apart from the side boundaries and a plurality of outer blastholes spaced around the central blastholes;

(c) loading each central blasthole with explosive to thereby form a vertical columar central explosive charge in each central blasthole;

(d) loading each outer blasthole with explosive to thereby form vertically spaced apart first and second columnar explosive charges in each outer blasthole, a portion of each such first outer explosive charge being closer to the void than any portion of each such central explosive charge is to the void, each such second outer explosive charge spaced more remote from the void than each such first outer explosive charge; and (e) detonating the explosive charges for explosively expanding the zone of unfragmented formation toward its substantially horizontal free face for forming a fragmented permeable mass of formation particles in the in situ oil shale retort.

22. The method according to claim 21 wherein each such first outer explosive charge has a first scaled depth of burial and each such second outer explosive charge has a second scaled depth of burial, the first and second scaled depth of burial being about equal.

23. The method according to claim 22 wherein the scaled depth of burial of each such first outer explosive charge is no more than the scaled depth of burial of each such central explosive charge.

24. The method according to claim 22 comprising detonating the explosive charges in a time delay sequence in a single round wherein the first outer explosive charges are detonated and, after a time delay, the second outer explosive charges and the central explosive charges are detonated.

25. The method according to claim 21 comprising detonating the explosive charges in a time delay sequence in a single round comprising detonating the central explosive charges, then detonating the first outer explosive charges, and thereafter detonating the second outer explosive charges.

26. The method according to claim 21 wherein the end remote from the void of each second outer explosive charge is about the same distance from the void as the end remote from the void of each central explosive charge.

27. A mehtod for forming a fragmented permeable mass of formation particles in an in situ oil shale retort having top, bottom, and side boundaries of unfragmented formation in a retort site in a subterranean formation containing oil shale, the method comprising the steps of:

forming at least one void within the retort site in the subterranean formation, leaving zones of unfragmented formation above and below such a void, the side walls of the void being a portion of the side boundaries of the retort being formed, with the surface adjacent the void of at least one of such zones of unfragmented formation forming a substantially horizontal free face towards which such a zone of unfragmented formation is to be expanded;

forming an array of horizontally spaced apart substantially vertical columnar explosive charges in the zone of unfragmented formation for explosively expanding said zone of unfragmented formation toward its substantially horizontal free face adjacent the void, the array of explosive charges comprising a plurality of central explosive charges remote from the side boundaries and a plurality of outer explosive charges horizontally spaced apart from the central explosive charges and around the central explosive charges, the outer explosive charges being horizontally spaced apart from said walls of the void less than about one-half the distance between adjacent central explosive charges, at least a portion of the explosive comprising each such outer explosive charge being closer to the substantially horizontal free face toward which the zone of unfragmented formation is being explosively expanded than any portion of the explosive comprising each such central explosive charge, and the scaled depth of burial of each such outer explosive charge being not more than the scaled depth of burial of each such central explosive charge; and detonating the central and outer explosive charges for explosively expanding the zone of unfragmented formation toward its substantially horizontal free face for forming a fragmented permeable mass of formation particles in the in situ oil shale retort.

28. The method according to claim 27 comprising forming the outer explosive charges with a powder factor higher than the powder factor of the central explosive charges.

29. A method for forming a fragmented permeable mass of formation particles in an in situ oil shale retort having top, bottom, and side boundaries of unfragmented formation in a subterranean formation containing oil shale, comprising the steps of:

forming at least one generally horizontally extending void in the subterranean formation, leaving zones of unfragmented formation above and below such a void;

forming an array of horizontally spaced apart substantially vertical blastholes in at least one of the zones of unfragmented formation, the array of blastholes comprising a plurality of central blastholes and a plurality of outer blastholes;

loading each of the central blastholes with explosive, forming a plurality of vertical columnar central explosive charges;

loading each of the outer blastholes with explosive, forming a plurality of vertical columnar outer explosive charges, each of the outer explosive charges having a different energy per unit volume of charge in a first portion of the length of the charge than the energy per unit volume of charge in a second portion of the length of the charge; and detonating the explosive charges for explosively expanding such a zone of unfragmented formation toward the void for forming a fragmented permeable mass of formation particles in the in situ oil shale retort.

30. The method according to claim 29 wherein each such outer explosive charge has a higher energy per unit volume in a portion of the charge more remote from the void and a lower energy per unit volume in a portion of the charge nearer the void.

31. The method according to claim 29 comprising initiating detonation of such an outer explosive charge at a point in the charge nearer the void than the point of initiation of detonation of each such central explosive charge.

32. The method according to claim 29 wherein the actual depth of burial of each such outer explosive charge is no more than the actual depth of burial of each such central explosive charge.

33. The method according to claim 29 wherein a portion of each such outer explosive charge is nearer the void than any portion of each such central explosive charge is to the void.

34. A method for explosively expanding formation toward a substantially horizontally extending free face of unfragmented formation in a subterranean formation, comprising the steps of:

forming at least one void in the subterranean formation, such a void bounded by generally vertical side walls and horizontally extending zones of unfragmented formation above and below, the surface adjacent the void of at least one of such zones of unfragmented formation forming a substantially horizontal free face towards which such a zone of unfragmented formation is to be expanded;

forming an array of horizontally spaced apart substantially vertical columnar explosive charges in the zone of unfragmented formation, explosive charges nearest the side walls of the void extending closer to the substantially horizontal free face of the zone of unfragmented formation than explosive charges more remote from the side walls of the void, the scaled depth of burial of the explosive charges nearest the side walls of the void being less than the scaled depth of burial of the explosive charges more remote from the side walls of the void; and detonating the explosive charges for explosively expanding the zone of unfragmented formation toward its substantially horizontal free face.

35. The method according to claim 34 wherein the explosive charges nearest the side walls of the void have a higher powder factor than the powder factor of explosive charges more remote from the side walls of the void.

36. The method according to claim 35 wherein the distance between adjacent explosive charges nearest the side walls of the void is less than the distance between adjacent explosive charges more remote from the side walls of the void.

37. The method according to claim 34 wherein the distance between adjacent explosive charges nearest the side walls of the void is about equal to the distance between adjacent explosive charges more remote from the side walls of the void.

38. The method according to claim 37 wherein the distance between such an explosive charge nearest a side wall of the void and an adjacent explosive charge more remote from such a side wall is about equal to the distance between adjacent explosive charges more remote from the side walls.

39. The method according to claim 34 wherein the explosive charges nearest the side walls of the void are longer than explosive charges more remote from the side walls of the void.

40. The method according to claim 39 wherein each of the explosive charges in such a zone of unfragmented formation has a far end remote from the free face and each far end is at about the same distance from the void as each other far end.

41. A method for forming a fragmented permeable mass of formation particles in an in situ oil shale retort having top, bottom, and side boundaries of unfragmented formation in a retort site in a subterranean formation containing oil shale, the method comprising the steps of:

forming at least one void within the retort site in the subterranean formation, such a void bounded by generally vertical side walls and horizontally extending zones of unfragmented formation above and below the void, the surface adjacent the void of each such zone of unfragmented formation forming a substantially horizontal free face towards which unfragmented formation is to be expanded;

forming an array of spaced apart explosive charges in each of the zones of unfragmented formation, such an array of explosive charges comprising at least one central explosive charge horizontally spaced apart from the side boundaries and at least one outer explosive charge horizontally spaced apart from and around the central charges, the actual depth of burial of each such outer explosive charge being less than the actual depth of burial of each such central explosive charge, and the scaled depth of burial of each such outer explosive charge being not more than the scaled depth of burial of each such central explosive charge; and detonating the array of explosive charges in each such zone of unfragmented formation for explosively expanding each zone toward its respective substantially horizontal free face for forming a fragmented permeable mass of formation particles in the in situ oil shale retort.

42. The method according to claim 41 wherein each such outer and central explosive charge has a first portion remote from the void wherein the first portion of each outer charge is about the same distance from the void as the first portion of each central charge.

43. The method according to claim 42 wherein each central charge extends into such a zone of unfragmented formation a distance equal to about one-half the thickness of the zone and each outer explosive charge extends into the zone a distance equal to about two-thirds to about three-fourths the thickness of the zone.

44. The method according to claim 41 wherein the distance between adjacent outer explosive charges is less than the distance between adjacent central explosive charges.

45. The method according to claim 41 wherein the distance between an outer explosive charge and an adjacent central explosive charge is about equal to the distance between the adjacent central explosive charges.

46. The method according to claim 41 wherein the distance between adjacent central explosive charges is about equal to the distance between adjacent outer explosive charges.

47. The method according to claim 46 comprising positioning outer explosive charges within such a zone of unfragmented formation such that the distance from each outer explosive charge to the closest wall of the retort adjacent thereto is not more than about one-half the distance between adjacent outer explosive charges.

48. The method according to claim 41 wherein the outer explosive charges vary in energy per unit volume of charge along their length.

49. The method according to claim 48 wherein the energy per unit volume of charge of each such outer explosive charge is lower in a portion of the outer explosive charge nearer the void and is higher in a portion of the outer explosive charge more remote from the void.

* * * * *

UNITED STATES PATENT AND TRADEMARK OFFICE

CERTIFICATE OF CORRECTION

PATENT NO. : 4,440,447

DATED : April 3, 1984

INVENTOR(S) : Thomas E. Ricketts et al

It is certified that error appears in the above-identified patent and that said Letters Patent are hereby corrected as shown below:

Col. 2, line 49, "application" should read -- Application --.

Col. 11, line 66, "movexent" should read -- movement --.

Col. 14, line 55, "explosvie" should read -- explosive --.

Col. 15, line 41, after "initiation" add -- of --.

Col. 16, line 38, "mehtod" should read -- method --.

Col. 16, line 65, "said" should read -- side --.

Signed and Sealed this

*Nineteenth* Day of *March 1985*

[SEAL]

*Attest:*

DONALD J. QUIGG

*Attesting Officer*

*Acting Commissioner of Patents and Trademarks*